US007384456B2

(12) United States Patent
Aubert

(10) Patent No.: US 7,384,456 B2
(45) Date of Patent: Jun. 10, 2008

(54) MODULAR FRAME FOR AIR PURIFICATION DEVICES

(75) Inventor: Patrick Aubert, Forges-les-Bains (FR)

(73) Assignee: AirInSpace B.V., Delft (NL)

( * ) Notice: Subject to any disclaimer, the term of this patent is extended or adjusted under 35 U.S.C. 154(b) by 59 days.

(21) Appl. No.: 11/445,087

(22) Filed: May 31, 2006

(65) Prior Publication Data

US 2007/0261555 A1 Nov. 15, 2007

Related U.S. Application Data

(60) Provisional application No. 60/800,657, filed on May 15, 2006.

(51) Int. Cl.
*B03C 3/12* (2006.01)

(52) U.S. Cl. ..... 96/77; 96/83; 96/84; 96/88; 96/92; 96/97; 96/100; 422/186.04

(58) Field of Classification Search ..... 96/29, 96/39–41, 52, 70, 77, 80, 83, 84, 88, 92, 96/94–100; 422/186.04
See application file for complete search history.

(56) References Cited

U.S. PATENT DOCUMENTS

| | | | | |
|---|---|---|---|---|
| 2,380,993 | A * | 8/1945 | Yungman | 96/84 |
| 2,789,656 | A * | 4/1957 | Richardson | 96/77 |
| 3,073,094 | A * | 1/1963 | Landgraf et al. | 96/66 |
| 3,137,550 | A * | 6/1964 | Fruth | 96/66 |
| 3,222,848 | A * | 12/1965 | Koble Jr. | 96/66 |
| 3,729,815 | A | 5/1973 | Quintillian et al. | |
| 3,985,525 | A | 10/1976 | Tomaides | |

(Continued)

FOREIGN PATENT DOCUMENTS

EP 0 240 476 10/1987

(Continued)

OTHER PUBLICATIONS

U.S. Appl. No. 11/408,737, filed on Apr. 18, 2006.

(Continued)

*Primary Examiner*—Richard L. Chiesa
(74) *Attorney, Agent, or Firm*—Beyer Law Group LLP

(57) ABSTRACT

A modular frame for use in air purification devices is described. In one aspect of the invention, a plurality of frame members are arranged in a linked stack to form a housing for components of an air purification device. The frame members are arranged to define a flow channel through which a fluid stream passes and to support components of the air purification device that receive the fluid stream. In another aspect of the invention, a plurality of rods are arranged to pass through the frame member stack. A first one of the rods serves as an electrical power source at a first potential and a second one of the rods serves as an electrical power source at a second potential. Electrical connectors are provided to electrically couple electrodes on selected components of the air purification device to their associated rods. In devices that utilize electrostatic filters, the electrodes that are connected to the rods may include the electrodes of the electrostatic filters. In devices that include ionizers or plasma chambers, the electrodes connected to the rods may include the discharge and/or receptor electrodes.

22 Claims, 10 Drawing Sheets

U.S. PATENT DOCUMENTS

| | | | | | |
|---|---|---|---|---|---|
| 3,999,964 | A | * | 12/1976 | Carr | 96/59 |
| 4,240,810 | A | | 12/1980 | Frauenfelder | |
| 4,261,712 | A | | 4/1981 | Kinkade | |
| 4,290,788 | A | | 9/1981 | Pittman et al. | |
| 4,478,614 | A | | 10/1984 | Jonelis | |
| 4,840,649 | A | | 6/1989 | Jonelis et al. | |
| 5,059,218 | A | * | 10/1991 | Pick | 96/66 |
| 5,108,470 | A | * | 4/1992 | Pick | 96/66 |
| 5,330,559 | A | * | 7/1994 | Cheney et al. | 95/63 |
| 5,474,600 | A | * | 12/1995 | Volodina et al. | 96/57 |
| 5,641,342 | A | * | 6/1997 | Smith et al. | 96/77 |
| 5,993,520 | A | * | 11/1999 | Yu | 96/66 |
| 6,805,732 | B1 | * | 10/2004 | Billiotte et al. | 96/66 |
| 6,958,089 | B1 | | 10/2005 | Huang | |
| 7,198,660 | B2 | * | 4/2007 | Billiotte et al. | 96/66 |
| 2002/0062739 | A1 | * | 5/2002 | Cheng | 96/66 |
| 2004/0144254 | A1 | * | 7/2004 | Wiser et al. | 96/66 |
| 2007/0137480 | A1 | * | 6/2007 | Bergeron et al. | 95/79 |

FOREIGN PATENT DOCUMENTS

| | | | | |
|---|---|---|---|---|
| JP | 52-51173 | A | * | 4/1977 |

OTHER PUBLICATIONS

U.S. Appl. No. 11/407,236 filed on Apr. 18, 2006.
U.S. Appl. No. 11/406,941, filed on Apr. 18,2006.
International Search Report dated Oct. 2, 2007 from corresponding International Appl. No. PCT/EP2007/054657.
Written Opinion dated Oct. 2, 2007 from corresponding International Application No. PCT/EP2007/054657.

* cited by examiner

MODULAR FRAME FOR AIR PURIFICATION DEVICES

CROSS REFERENCE TO RELATED APPLICATION

This application claims priority benefit of U.S. Provisional Patent Application No.: 60/800,657, filed May 15, 2006, entitled "MODULAR FRAME FOR AIR PURIFICATION DEVICES," which is hereby incorporated herein by reference.

BACKGROUND OF THE INVENTION

The present invention relates generally to modular frames suitable for use in air purification devices.

There are currently a wide range of technologies that are used to purify and/or filter air. One such technology is the electrostatic filter. Generally electrostatic filters include a porous dielectric material that is positioned between a pair of electrodes. A fluid stream (e.g., air) is arranged to pass through the dielectric material. In an active electrostatic filter, a significant potential difference is applied across the electrodes in order to induce an electrostatic field in the dielectric material that is sufficient to cause particulates within the air stream passing through the filter to adhere to the dielectric.

More recently, ion enhanced electrostatic filters have been developed. An ion enhanced electrostatic filter contemplates placing an ion source in front of the electrostatic filter to impart an electric charge to some of the particulates carried by air passing through the filter. The charges imparted to the particulates by the ionizer tend to help their collection within the dielectric.

U.S. Pat. No. 5,474,600, which is owned by the assignee of the present application, discloses an apparatus for the biological purification and filtration of air. Generally, the '600 patent discloses a system which utilizes a course electrostatic filter 1, a cylindrical or polygonal ionizer 5 and a fine electrostatic filter 10 that are all arranged in series. In some of the described embodiments, a pair of ionizers that impart opposite charges are arranged in series between the course and fine electrostatic filters. The system is arranged to inactivate (i.e. kill) biological objects (e.g., microorganisms and viruses) that are carried in the air stream and to filter particulates from the stream.

Commercial embodiments of this type of air purification and filtration system have been successfully used in the MIR space station and in hospitals to purify, filter and decontaminate air. A representative commercial embodiment of such a system is diagrammatically illustrated in FIG. 8. As seen therein, the system 20 include an electrostatic pre-filter 22, a positive plasma generator 24 that is arranged in series with a negative plasma generator 26 and a series of four electrostatic filters 28 that are arranged downstream of the negative plasma generator 26. Each D.C. plasma generator 24, 26 is composed of a plurality of cylindrical plasma cylinders (e.g., 6 cells) arranged in parallel. In various embodiments it may be desirable to vary the nature, number and placement of the various components (e.g., the filters and the plasma generators) and/or to add components (such as catalysts) to the systems. By way of example, U.S. Provisional Application No. 60/751,497 (which is incorporated herein by reference) describes a variety of different reactor designs. Although the described system works well, there are continuing efforts to provide improved and/or more cost effective purification and/or filtering device designs that can meet the needs of various applications.

SUMMARY OF THE INVENTION

To achieve the foregoing and other objects of the invention, modular frames for use in air purification devices are described. A plurality of frame members are arranged in a linked stack to form a housing for components of an air purification device. The frame members are arranged to define a flow channel through which a fluid stream passes and to support components of the air purification device that receive the fluid stream.

In one aspect of the invention, a plurality of rods are arranged to pass through the frame member stack. A first one of the rods serves as an electrical power source (e.g. bus bar) at a first potential and a second one of the rods serves as an electrical power source at a second potential. Electrical connectors are provided to electrically couple electrodes on selected components of the air purification device to their associated rods. In devices that utilize electrostatic filters, the electrodes that are connected to the rods may include the electrodes of the electrostatic filters. In devices that include ionizers or plasma chambers, the electrodes connected to the rods may include the discharge and/or receptor electrodes.

When desired more than two rods may be used as electrical power sources at different potentials. This is particularly useful in embodiments where it is desirable to operate an ionizer or a plasma generator or other components at a different potential difference than the electrostatic filters.

In another aspect of the invention, the frame members are formed from a plurality of rails. Each rail includes an inner wall, a shelf that extends inward from the inner wall and a retention member that extends from the shelf. The height of the retention member is less than the height of the inner wall. With this arrangement, a component seated on the shelf of a first frame member may be held in place by the retention member of an adjacent frame member.

In some embodiments, the frame member includes one or more seal structures arranged to engage mating structures on an adjacent frame member to provide a fluid seal between the fluid flow channel and a surrounding environment. The frame members may also each include at least one latch mechanism suitable for securing the frame member to an adjacent frame member.

In some embodiments, at least some of the rails include inner and outer walls and a cross beam member that couples the inner and outer walls. In such embodiments, alignment rods may optionally be arranged to pass through corresponding openings in the cross member.

In some embodiments, the frame members are standardized such that they have substantially the same dimensions and shape. In other embodiments, the frame members may be characterized into a few standardized configurations that fit well together.

BRIEF DESCRIPTION OF THE DRAWINGS

The invention, together with further objects and advantages thereof, may best be understood by reference to the following description taken in conjunction with the accompanying drawings in which:

FIG. 1(*b*) is a diagrammatic cross sectional side view of a modular reactor in accordance with another embodiment of the present invention;

In the drawings, like reference numerals are utilized to designate like structural elements. Also, it should be appreciated that the depictions in the figures are diagrammatic and not to scale.

DETAILED DESCRIPTION OF THE PREFERRED EMBODIMENTS

The present invention relates generally to modular frames suitable for use in air (or other gaseous fluid) purification devices.

Figure 1A:
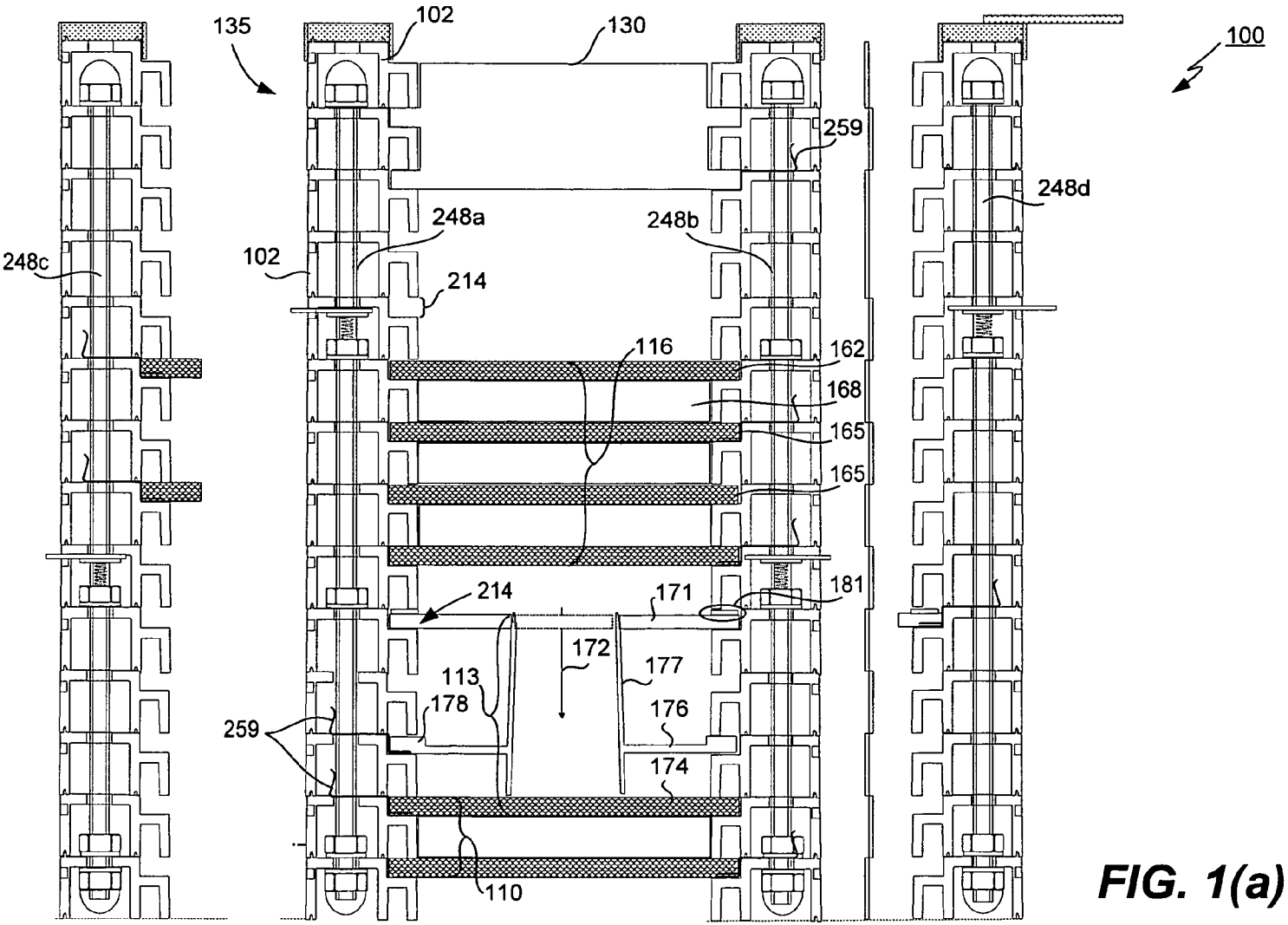
FIG. 1(*a*) is a diagrammatic cross sectional side view of a modular reactor in accordance with one embodiment of the present invention.
Figure 1B:
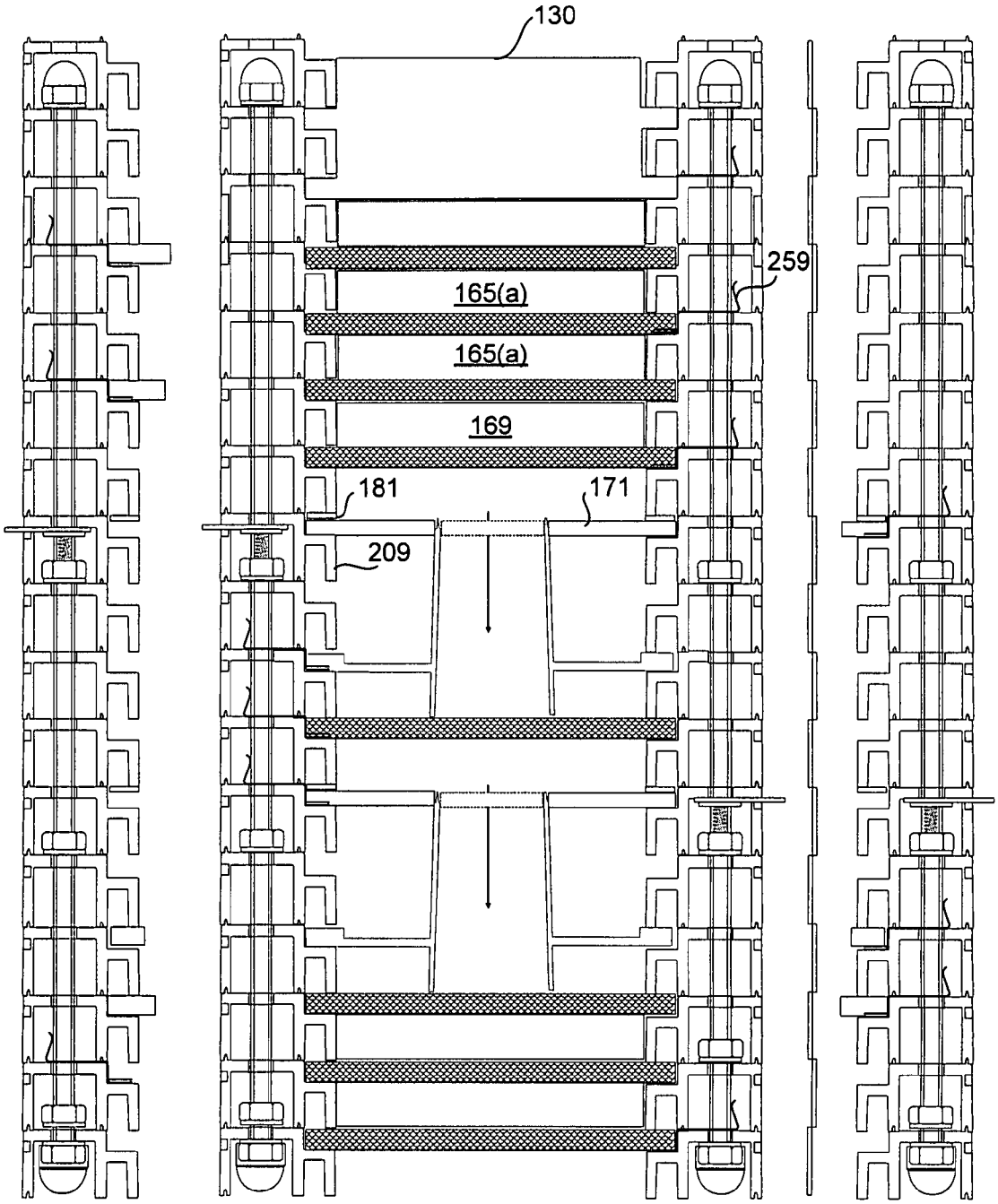

Referring initially to FIG. 1(*a*), a plasma reactor in accordance with a first embodiment of the invention will be described. In the first illustrated embodiment, the plasma reactor 100 includes an electrostatic pre-filter 110, a plasma generator 113, a series of three active electrostatic filters 116 and a catalyst 130 that operates as a catalytic converter. These components are all arranged in series so that a gaseous fluid (e.g. air) entering the reactor 100 initially passes through the pre-filter 110 and then sequentially passes through the plasma generator 113, the electrostatic filter 116 and the catalyst 130 before exiting the reactor. Each of these reactor components are supported by a frame 135 composed of a multiplicity of stacked frame members 102. Each frame member 102 takes the form of a closed ring that circumscribes a large central opening that defines a part of a flow channel through which the fluid stream being filtered passes.

Figure 2:
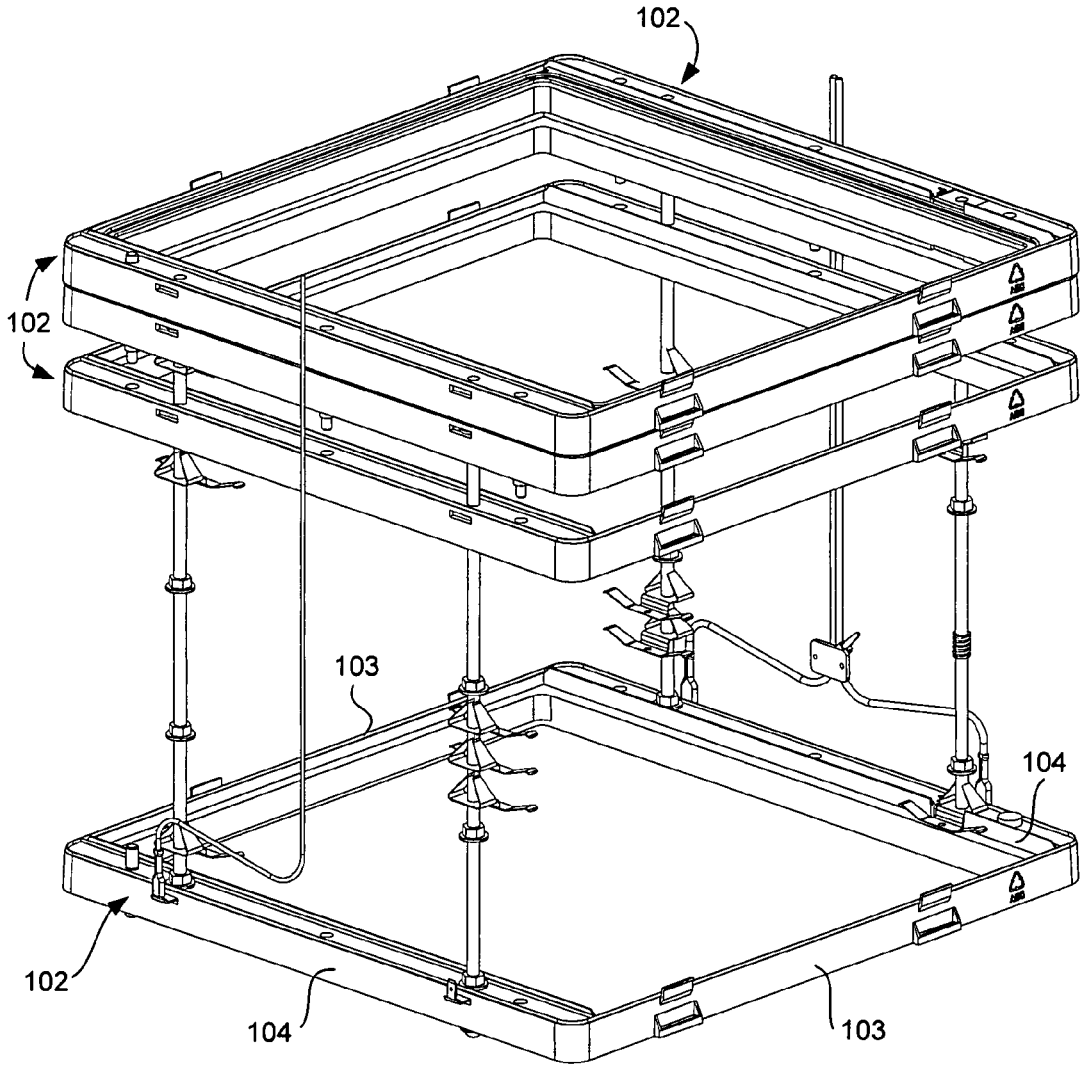
FIG. 2 is a partially exploded perspective view of several stacked modular frame members that are suitable for use in supporting components of the modular reactors illustrated in FIGS. 1(*a*) and 1(*b*)

Representative frame members 102 are illustrated in FIGS. 2-7. As seen in FIG. 2 each frame 102 takes the form of a closed ring. The geometry of the perimeter of the frame may vary widely. In the illustrated embodiment, the frames have a substantially square footprint, although the corners are rounded somewhat. However, the peripheral geometry of the frame may take any suitable shape and in many applications may be customized to fit the dimensions of existing, standardized or envisioned air handling systems that the reactor may be integrated with. By way of example, substantially rectangular, hexagonal, annual, oval, polygonal, or other peripheral shapes may all be used.

Figure 3:
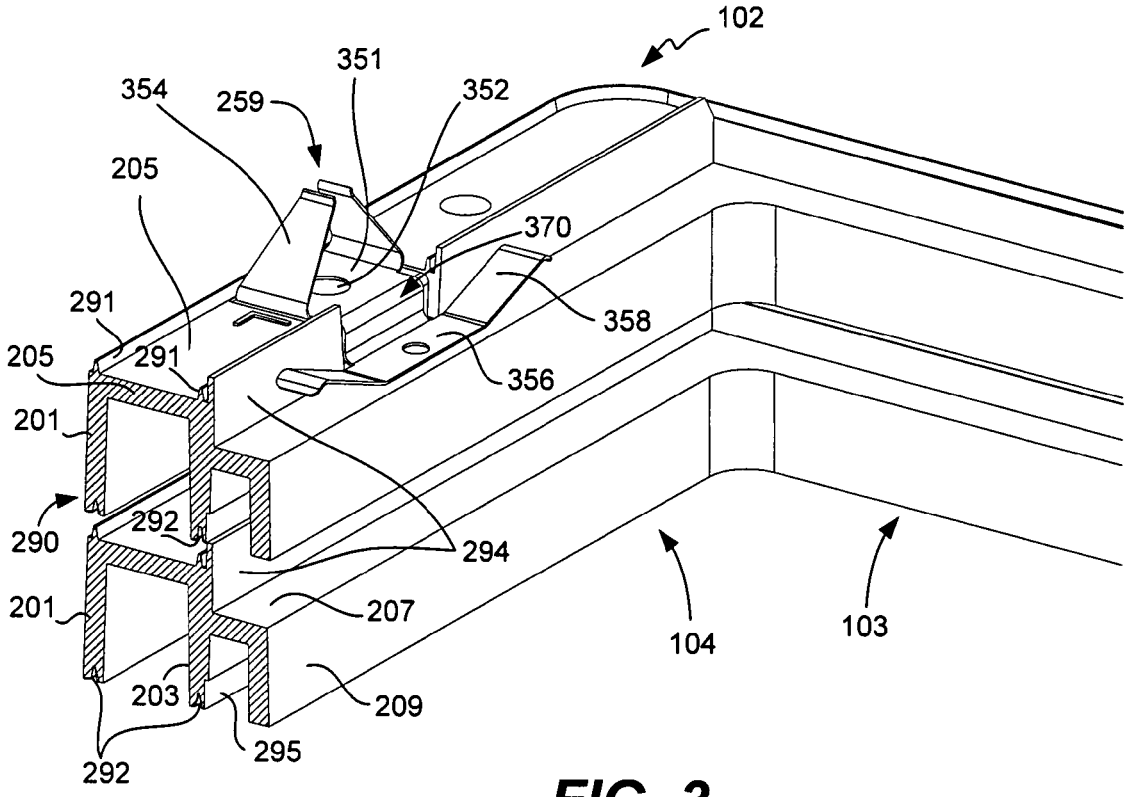
FIG. 3 is a cross sectional perspective view of a pair of stacked side rail segments of the modular frame member illustrated in FIG. 2 viewed from an internal perspective with an electrical connector clip positioned on the upper side rail.

In the embodiment shown, the frame member 102 is composed of four rails including two end rails 103 (described in greater detail in FIG. 4) and two side rails 104 (described in greater detail in FIG. 3). The various rails may have the same or different constructions. In the embodiments shown, the side rails have similar constructions and the end rails have similar constructions although the side and end rails have different constructions. Additional rails can be provided as needed such that the frame may have any desired footprint geometry (e.g., triangular, hexagonal, etc.). In the embodiments shown, the rails are substantially straight. However, this is not a requirement and the rails may have any lengthwise geometry that is appropriate to meet the needs of a particular application (e.g. curved so that the reactor may fit within a circular cross section duct, etc.).

In the embodiment illustrated in FIG. 3, each side rail of the frame member 102 includes an outer wall 201 and an inner wall 203 that are coupled by a cross member or beam 205. A shelf 207 extends inward from the inner wall 203 and a flange (retention member) 209 depends from the shelf. The height of the flange 209 is less than the height of the inner and outer walls so that when the frames are stacked, there is a gap 214 between the flange and the shelf of an adjacent stacked frame member such that the shelf is exposed (see, e.g., FIG. 1(*a*)).

Figure 4:
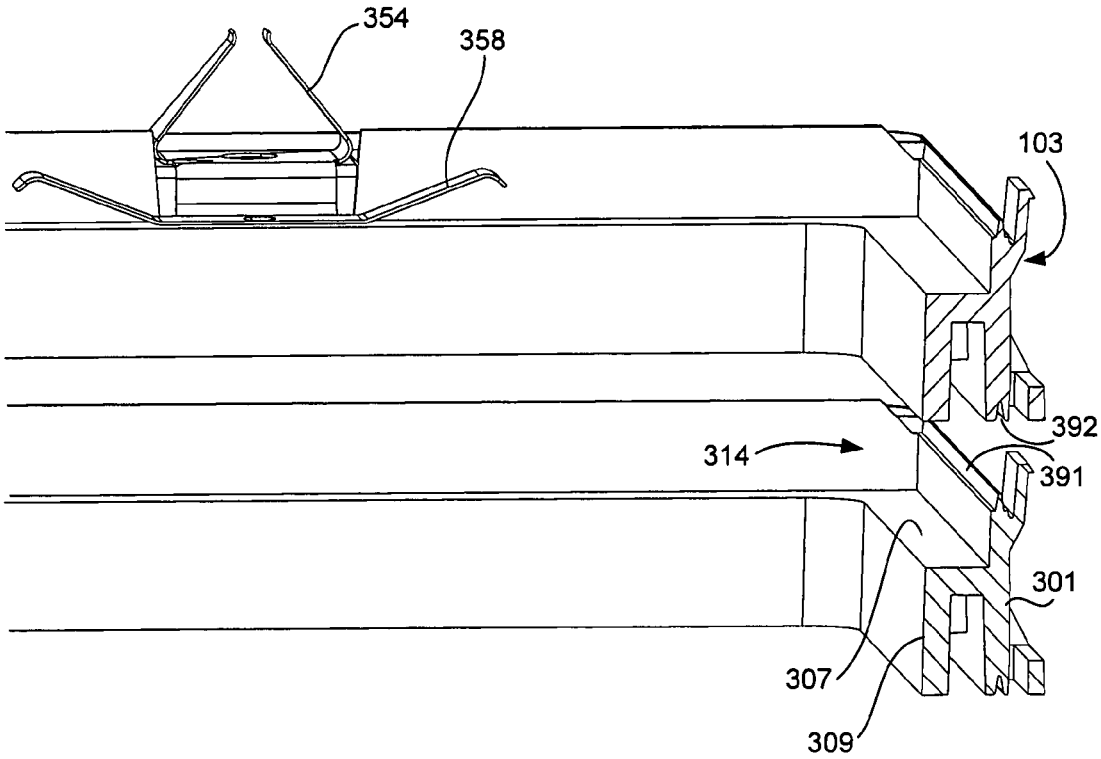
FIG. 4 is a cross sectional perspective view of a pair of stacked end rail segments of the modular frame member illustrated in FIG. 2 viewed from an internal perspective.
Figure 5:
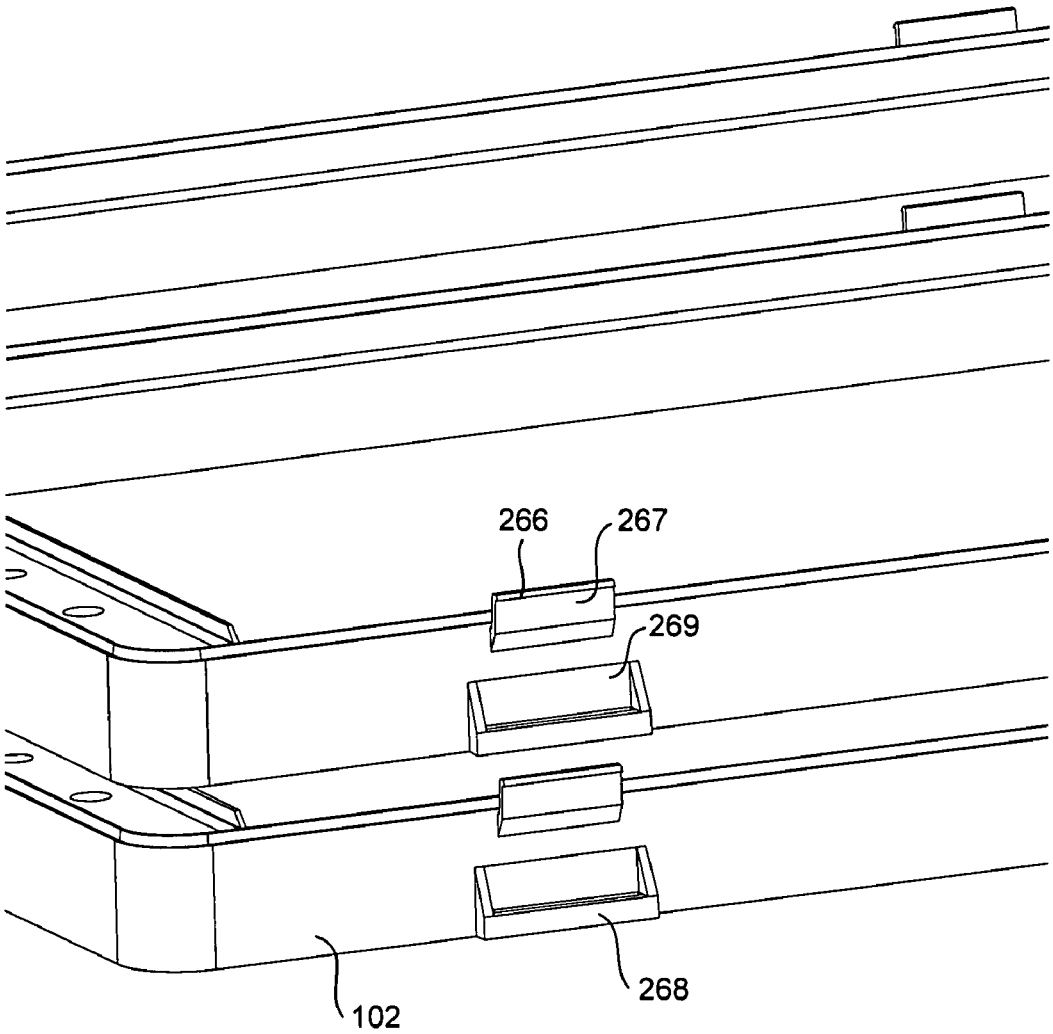
FIG. 5 is a perspective view of a pair of stacked side rail segments of the modular frame member illustrated in FIG. 4 viewed from an external perspective and highlighting clips used to secure adjacent frame members.

As best seen in FIG. 4, the end rails have a single wall 301, a shelf 307 that extends inward from the wall 301 and a flange 309 that depends from the shelf 307 in the same way that flange 209 depends from shelf 207 on the side walls. Thus, the height of the flange 309 is less than the height of the wall 301 so that when the frames are stacked, there is a gap 314 between the tip of the flange and the shelf of an adjacent frame member that matches the height of gap 214.

With this arrangement, selected internal reactor components can effectively be held in place by the shelves cooperating with the flanges of the overlying frame member. In some circumstances the components that are held in place can be sized to have a thickness that is slightly larger than the gap so that the flanges 209, 309 affirmatively clamp the component in place. However in other arrangements, the components can be slightly thinner than (or nominally the same thickness as) the gap so that the flange serves to generally retain (or prevent substantial movement of) the component without applying an affirmative clamping force. The arrangement of the frame members will be described in more detail below.

Each frame member 102 includes a latch mechanism suitable for securing the frame to an adjacent frame. The latch mechanism can take any suitable form. By way of example, in the embodiment illustrated in FIG. 5, each frame member includes a plurality of clips 267 that are each arranged to engage an aligned latch 269 located on a second frame member that is stacked on a first side of the initial frame member (e.g. a second frame member that is positioned above the first frame member). See, e.g., FIGS. 2 and 5. Each frame member also includes a plurality of latches. Each latch is generally aligned with one of the clips (e.g. positioned below one of the clips) and is arranged to engage a clip located on a third frame member that is stacked on a second side of the initial frame member (e.g., a third frame member that is positioned below the first frame member). The latching mechanism may be used to securely snap frame members together to form a frame stack. The clips 267 have a ledge 266 that snaps over a latch bar 269 on the latch 269 when adjacent frame members are stacked together. The clip is cantilevered and formed from a somewhat flexible material (such as plastic) so that the ledge can be released by pressing the clip in such that the ledge 266 moves free of the latch bar 268.

In the embodiment shown in FIG. 2, the end rails 103 located on two opposing ends of the frame each include a pair of spaced apart clips 267 that are arranged to engage corresponding latches 269 on the adjacent frame. However, it should be appreciated that the number of latch mechanisms provided on a frame, as well as their respective positioning may be widely varied. Additionally, although a clip and latch type latch mechanism is used in the illustrated embodiments, it should be appreciated that a wide variety of different latch mechanism may be used to accomplish the same function.

Referring again to FIG. 3, the frame member 102 also has sealing structures 290 that are arranged to provide a good fluid seal between adjacent stacked frame members. FIG. 3 is a cross sectional view of a pair of side rails 104. Each side rail has a pair of sealing rims 291, with a first one of the sealing rims being provided at the top of the inner wall 203 and the other being provided at the top of the outer walls 201. The sealing rims 291 are sized to mate with corresponding sealing troughs 292 located on the bottom surface of the walls of an adjacent frame member in order to provide a fluid seal between the frame members. The inner wall 203 also has an internal wall projection 294 that projects upward from the top surface of the inner wall 203 so as to extend the inner periphery of the inner wall. A coffesponding slot 295 is formed along the lower internal surface of the inner wall. The slot 295 mates with the internal wall projection 294 to form another sealing surface.

The end rails 103 have a sealing structure as well. As best seen in FIG. 4, the wall 301 has a sealing rim 391 that engages a corresponding trough 392 formed in the bottom surface of the wall of an adjacent frame member to provide a good fluid seal. Although the described sealing structures work well, it should be appreciated that a wide variety of alternative seal structures may be used to prevent substantial leakage into or out of the reactor.

A wide variety of materials may be used to form the frame members. Preferably, the frame members are formed from a non-conductive material that is easily moldable. Thus, the frame member can help electrically isolate various electrically charged components within the reactor. By way of example, plastic materials such as Acrylonitrile Butadiene Styrene, polycarbonate or polypropylene work well although a number of other materials including various ceramic and other dielectric materials may be used as well.

Figure 6A:
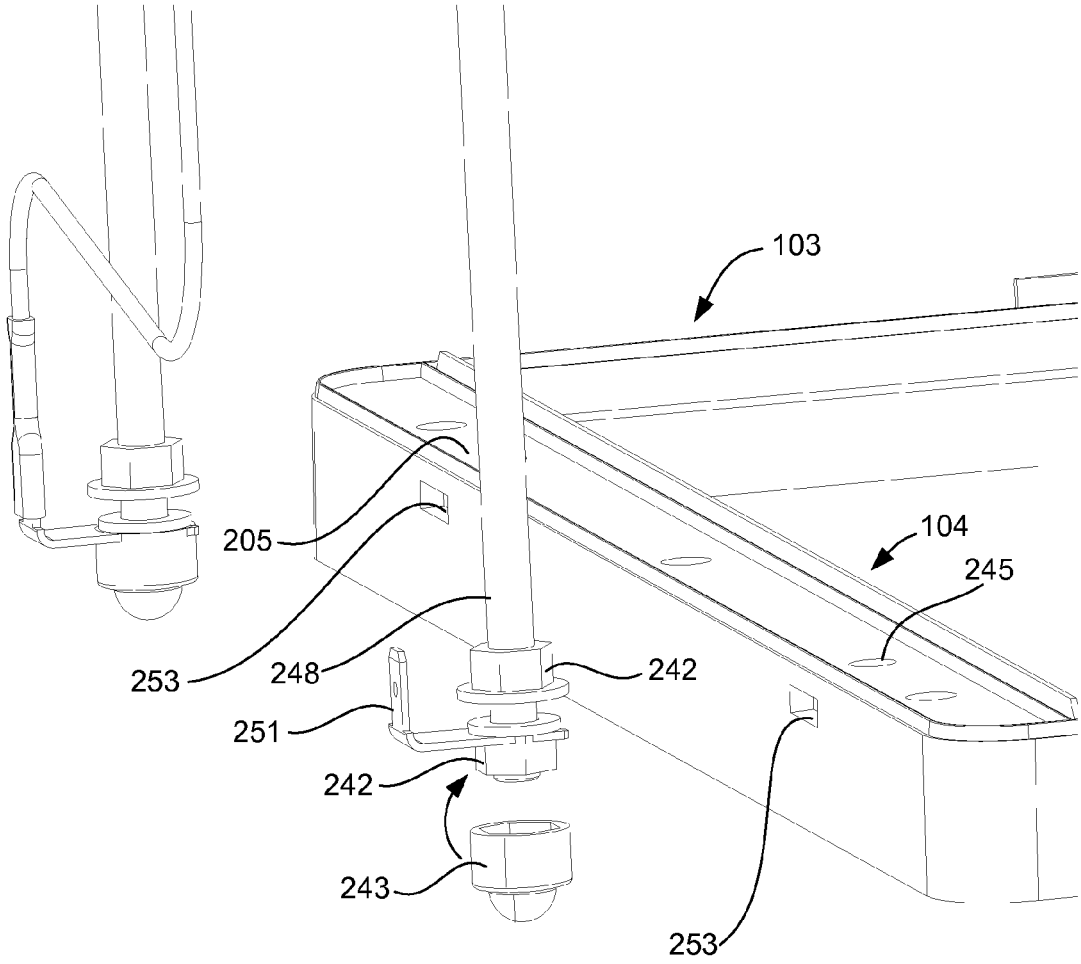
FIGS. 6(*a*) and 6(*b*) are perspective views illustrating the rods/electrical buses used in the embodiments illustrated in FIGS. 1(*a*) and 1(*b*)
Figure 6B:
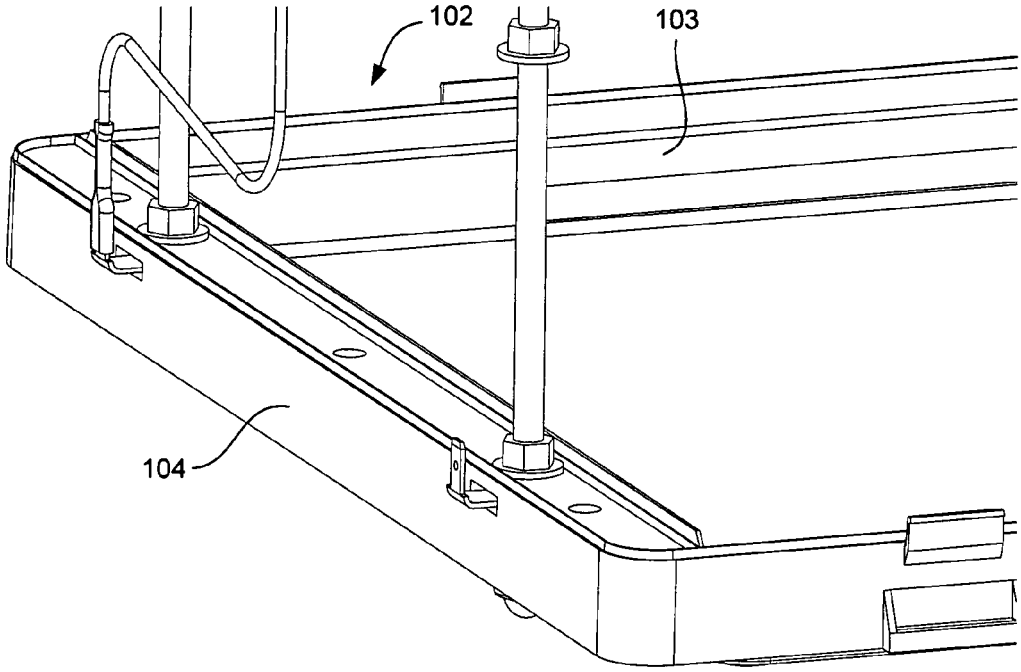

As best illustrated in FIG. 6, the side rails 104 also have alignment holes 245 in the cross beam members 205. The alignment holes 245 are arranged to receive rods 248. The rods 248 are electrically conductive and as will be described in more detail below, can be used as power buses for electrical components within the reactor 100. In some embodiments, the rods 248 are arranged to extend the entire length of the frame stack. In the embodiment illustrated in FIG. 6, the ends of the rods are threaded so that nuts 242 can be secured to rod. In the illustrated embodiment a pair of nuts 242 are used to secure an electrical connector 251 to the rod 248. Each end of the rod is capped with an insulated cap nut 243 to insulate external devices from the electrically conductive rods. When the rods 248 are threaded, they can double as bolts that help hold (or hold) the frame members together. That is, they can be used to assist the latch mechanisms in holding the frame stack together or in place of the latch mechanisms.

Any number of rods may be provided. In the illustrated embodiments, a total of four rods are provided. However, it should be appreciated that the actual number of rods may be varied to meet the needs of a particular design. In some embodiments, (and particularly embodiments that utilize other electrical connection schemes) the rods may be eliminated altogether.

FIG. 6(*a*) is an exploded perspective view that shows the rods before they have been installed in a frame stack. FIG. 6(*b*) shows the rods installed on the lowest frame member. As can be seen in both figures, the outer walls of side rails 104 have small ports 253 arranged to receive the electrical connector 251. The ports 253 may optionally be formed from frangible punch out elements that can be broken out of the side rail when necessary for use.

As previously discussed, the reactor 100 has a number of components including a plurality of electrostatic filters. Each electrostatic filter 116 includes porous positive and negative electrodes 162, 165 that are separated by a suitable porous dielectric material 168. The electrodes 162, 165 are porous so that air passing through the reactor can pass through the electrodes. A relatively high potential difference is applied across the dielectric material. By way of example, potential differences of 4-40,000 volts or greater are preferred. Generally it is desired (but not required) to generate a field having a strength of at least 1000 V/cm. In some designs, the potential difference between the electrostatic filters electrodes is the same as the potential difference between the discharge and receptor electrodes in the plasma generators. However, this is not a requirement, and often it may be desirable to utilize higher potential differences for the filter electrodes. By way of example, such an arrangement is illustrated in the embodiment of FIGS. 1(*a*) and 1(*b*).

The electrodes may be formed from a variety of different materials. By way of example, metals, conductive polymers or other conductive materials can be used to form the electrodes. In one specific embodiment, metallized open cell foams as described in U.S. Pat. No. 6,805,732 are used to form the electrodes. Other suitable electrodes, including a variety of insulated electrodes, are described U.S. Provisional Application No. 60/751,497. The dielectric can also be formed from a variety of different materials. A variety of suitable dielectric materials are described in the same two patent applications. In the embodiments shown, the electrodes take the form of electrode plates that are sized to fill the opening within an associated frame member 102 and rest on the shelf 207, 307 of the member 102 as shown in FIGS. 1(*a*), 1(*a*), 3, and 4. The relative thickness of the plates (at least in a peripheral region) is selected in conjunction with the standoff distance (e.g., gap 214) between the shelves 207, 307 of the associated frame members 102 and the flanges 209, 309 of the adjacent frame member. With this arrangement the shelf and flange effectively work to hold the electrode in place. In some embodiments, the height of the gap 214 may be slightly less than the thickness of the electrode so that the flanges 209, 309 affirmatively clamp the electrode in place. In other embodiments, the height of the gap may be slightly greater than (or nominally the same as) the thickness of the electrode so that the flanges 209, 309 prevent substantial movement of the plate without applying a clamping pressure.

The dielectric 169 is sized so that it substantially fills the opening between a pair of electrodes. In the embodiment shown, the dielectrics do not extend onto the shelves of the frame member but rather are sized to abut or nearly abut the inner side of the flanges 209, 309. The thickness of the dielectric can vary somewhat, but typically its thickness will be sized to fill the gap between its associated electrodes with no or little compression. This is because compression of the dielectric generally tends to reduce the efficiency of the dielectric in part by reducing its void fraction. However, in some implementations it may be desirable to apply a compressive force to the dielectric and the described arrangement is well suited for applying such a compressive force by simply selecting the free thickness of the dielectric appropriately.

In the embodiment shown in FIG. 1(*a*), a series of three electrostatic filters 116 are provided, while four are shown in the embodiment of FIG. 1(*b*). It can be seen that the intermediate electrodes 165 serve as electrodes for two adjacent electrostatic filters. This is not a requirement, although it has cost advantages and improves the compactness of the system. It should be appreciated that the size of the electrostatic filter stack can be readily adjusted simply by adding or subtracting additional electrodes and dielectric layers to the stack. The modular frame described herein makes such variations very easy to assemble.

The pre-filter 110 is generally intended to trap large particles. The pre-filter can be any type of filter including electrostatic filters and simple replaceable mechanical filters. In the embodiment illustrated in FIG. 1(*a*), an electrostatic pre-filter is used. However in other embodiments, a simple replaceable mechanical non-woven mat type pre-filter or other types of pre-filters may be used. When desired, more than one pre-filter can be provided. By way of example, in the embodiment illustrated in FIG. 1(*b*) a two electrostatic filter stack is used. In other embodiments, electrostatic pre-filters may be provided in series with mechanical filters or the like. When electrostatic pre-filters are used, they may be held in place in the same manner described above with respect to the main electrostatic filters. When mechanical or other pre-filters are used, it may be desirable to include a rim or plate or other mechanical structure on the pre-filter that is sized to rest on the shelf of an associated frame member 110 while being engaged and/or retained by the flange of the adjacent frame member in order to hold the pre-filter in place.

Referring again to FIG. 1(*a*), other components within the reactor 100 may be held in place using the same or similar approaches. Sometimes the structure (e.g. base plate, rim, tabs, etc.) of a component that is intended to engage the shelf may be thinner than the gap 214. If this difference is too great, it may be desirable to eliminate some of the resulting slop. This can be addressed in a variety of ways. For example, gaskets, spacers, tabs or rim structures may be applied to peripheral portions of the base structures in order to provide the thickness desired to engage the flanges 209, 309 of adjacent frame members. These structures may be integrally formed with the base structure, attached to the base structure or provided as separate parts. By way of example, the plasma generator 113 illustrated in FIG. 1(*a*) includes a base plate 171 that may take the form of a printed circuit board. The footprint of the printed circuit board is sized so that it rests on the shelf of an associated frame member. However its thickness is less than the height of the gap 214. Accordingly, a spacer or gasket 181 is applied to the base plate to fill the gap. Again, the thickness of the spacer may be adjusted to control the clamping force (if any) applied by the flanges 209, 309 when the frame is assembled. In some embodiments, the spacers are adhered to the base plate 171, while in other embodiments, the spacers may be free standing. The spacers may take any suitable form, as for example rings, strips, wedges, etc.

The plasma generator may take a variety of different forms. By way of example, suitable plasma generators are described in U.S. Pat. No. 5,474,600 and co-pending U.S. provisional application No. 60/751,497. The plasma generators described in these applications utilize a plurality of plasma chambers that are generally elongated in the direction of the airflow with the discharge electrodes extending substantially parallel to the airflow and generally co-axially with the chamber walls. These types of plasma chambers are generally referred to herein as co-axial plasma chambers.

In the diagrammatic illustration of FIGS. 1(*a*) and 1(*b*), a single chamber is shown to represent each plasma generator. However, in most implementations that use co-axial plasma chambers, it is desirable to provide a plurality of plasma chambers arranged in parallel for each plasma generator. The number of plasma chambers used for each plasma generator will depend on a number of factors including the size of the generators and the amount of airflow that the plasma reactor is designed to accommodate. By way of example, a representative plasma generator may be composed of 12 adjacent plasma chambers arranged in parallel, with each plasma chamber having a hexagonal cross section with co-axial needle type discharge electrode. However, the cross sectional shape of the chambers may be any of a variety of other appropriate shapes (e.g., circular, oval, octagonal, or other polygonal shapes). In one particular implementation, the chamber walls are cylindrical and have an internal diameter in the range of 0.5 to 10 cm (as for example 5 cm). The discharge electrodes 172 are positioned co-axially with the chambers. In another particular implementation, the chamber walls are hexagonal and have minimum chamber widths in the range of 0.5 to 10 cm (as for example 5 cm).

In the embodiment shown in FIG. 1(*a*) a single plasma generator (which would have a plurality of parallel plasma chambers) is shown. The single plasma generator could be either a positive plasma generator or a negative plasma generator. In the illustrated embodiment, a negative plasma generator is shown. In the embodiment shown in FIG. 1(*b*) a pair of plasma generators are provided (i.e., a positive plasma generator and a negative plasma generator).

As can be seen in FIGS. 1(*a*) and 1(*b*), the length of the plasma generators is significantly longer than the height of a single frame member 102. In the illustrated embodiment, the receptor electrode 174 (which also acts at an electrode for an adjacent electrostatic prefilter) is clamped in place as described above with respect to the electrostatic filter electrodes. The remaining portion of the plasma generators extend to the height of three stacked frame members 102. The base plate 171 is held in place on the shelf of the frame member located three above the frame member that the receptor electrode 174 rests on. An intermediate support member 176 is also provided to help support the plasma chambers 113, for example supporting a chamber wall 177. The support member 176 is sized to rest on the shelf of an associated frame member 102 and includes a peripheral rim 178 that may be engaged by the flanges 209, 309 of the adjacent frame member. The support member 176 may be formed from a conductive material (such as metal) or have conductors placed thereon to provide the desired electrical conductivity to the walls of the plasma chamber which are preferably used as additional receptor electrodes. If the size of the plasma chamber merits it, multiple spaced apart support members may be provided, with each support member resting on the shelf of an associated frame member. Of course, the relative length of the plasma generator 113 may be widely varied and the appropriate number of frame members may be used to define the channel in the region of the plasma generator.

Although, the described co-axial plasma chambers work very well and can be constructed at a relatively modest cost, it should be appreciated that a variety of other ion generating technologies may be used to create the desired plasmas or ionization zones. For example, RF, microwave, UV or other D.C. ion generators could be used in place of the co-axial plasma chambers in various embodiments. In other applications it will be desirable to combine different types of ion/plasma generators in the same reactor. For example, it may be desirable to combine a UV ion generator in combination with the described co-axial D.C. ion generators. These devices can all be readily adapted to be held in place by the described modular frame stack.

The reactor 100 illustrated in FIG. 1(*a*) also has a catalyst block 130. Some of the uses of the catalyst are described in detail in provisional application No. 60/751,497. Like the plasma chamber, the catalyst may be carried by appropriate support members that are designed to be held in place by the frame members 102.

It should be apparent that the described frame stack approach is very modular and is particularly well suited for supporting reactors having a wide variety of different configurations and/or designs. That is, components may readily be added, subtracted or changed to the reactor configuration by simply adding the required number of frame members.

As suggested above the rods 248 serve as bus bars that are arranged to supply electrical power to the various electrical components of the reactor 100 such as the electrodes used in the electrostatic filters and plasma generators. If the same potential difference is used between the electrodes in the electrostatic filters and the receptor and discharge electrodes used in the plasma generator, then just two rods may be provided. Alternatively, in an example where a larger number (e.g. 4) rods are used, only two need be electrically active as bus bars. In embodiment where more distinct power sources potentials are desired, additional rods can be added or made into bus bars.

A variety of mechanisms may be used in order to electrically connect the rods to their associated components. By way of example, one such electrical connector 259 is illustrated in FIGS. 3 and 4. As seen therein, the connector 259 includes a first flat section 351 that is arranged to sit on the cross beam member 205 of an associated frame member. The first flat section 351 has a hole 352 that is suitable for receiving the rod. A pair of spring loaded flaps 354 extend upward from the first flat section 351 and are arranged to press against and engage the rod 248 to form a good electrical connection with the rod. A second flat section 356 is arranged to rest on the shelf 209 of the associated frame member. The two flat sections are connected by a bent section that fits into a recess 370 in the inner wall 203 and is curved to generally extend along the inner wall as it steps from the cross beam 205 to the shelf 209. The second flat section 356 has a pair of spring arms 358 that splay upward and outward along the shelf. When an electrode or other component is placed on the shelf, it flattens the spring arms. The spring force in the arms insures a good electrical connection between the connector 259 and the electrical or other component.

In some embodiments, such as depicted in FIG. 6(*a*), the recesses 253 are provided adjacent each alignment hole 245. In other embodiments, frangible punchouts are formed in the inner wall adjacent each alignment hole. The punchouts may be removed during assembly in order to form the recesses. With this affangement, the recesses only need to be formed adjacent the rods that are being electrically connected to the adjacent component.

With the described arrangement, each component that rests on a shelf may be electrically connected to one of the rod bus bars simply by inserting a connector 259 on the appropriate rod. This can be used to power the electrodes on the electrostatic filters, the receptor and discharge electrodes on the plasma generator/ionizer, catalysts electrodes and/or any other components of the reactor. The connectors that make electrical connections between the rods 248 and the electrode in the various reactor components are shown in FIGS. 1(*a*) and (*b*). Rod 248*a* is the positive power source for the corona discharge devices. As such, it is maintained at a positive potential that is suitable for use in the receptor electrodes of the plasma generator. Accordingly, it can be seen that connectors 259 electrically couple rod 248*a* to the receptor electrode 174 and the support member 176 (which charges the chamber walls). Rod 248*b* is maintained at the negative or lower potential for the corona discharge devices. In the illustrated embodiment it is maintained at a ground potential and is connected to the base plate 171 (and in turn discharge electrode 172) on the plasma generator. Rod 248*c* (which is illustrated in exploded form to the left side of rod 248*a* serves as the positive bus bar for the electrostatic filters. As such, it is maintained at a higher positive potential than rod 248*a*. Rod 248(*d*) is maintained as the negative bus bar for the electrostatic filters. Thus, it may be maintained at a negative or ground potential.

The rods can also be used to electrically connect other components within the reactor. For example, provisional application No. 60/751,497 describes the use of insulated electrodes that have conductive surfaces that are used to prevent the buildup of opposing charges on the surface of the electrode insulation. In some implementations, it may be desirable to electrically connect the conductive surfaces and one of the alignment bars together with suitable conductors as described above may be used as part of the circuit that connects the conductive surfaces.

Figure 7:
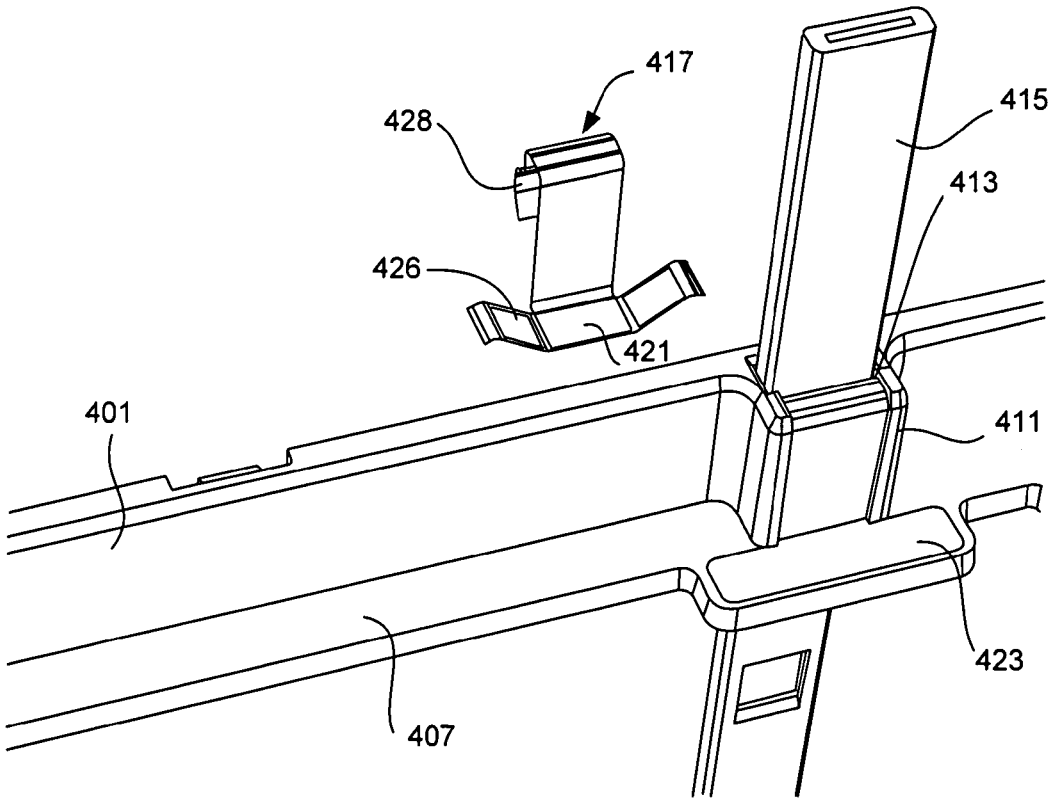
FIG. 7 is a diagrammatic perspective view illustrating alternative embodiments of the rod and electrical connector clip.
Figure 8:
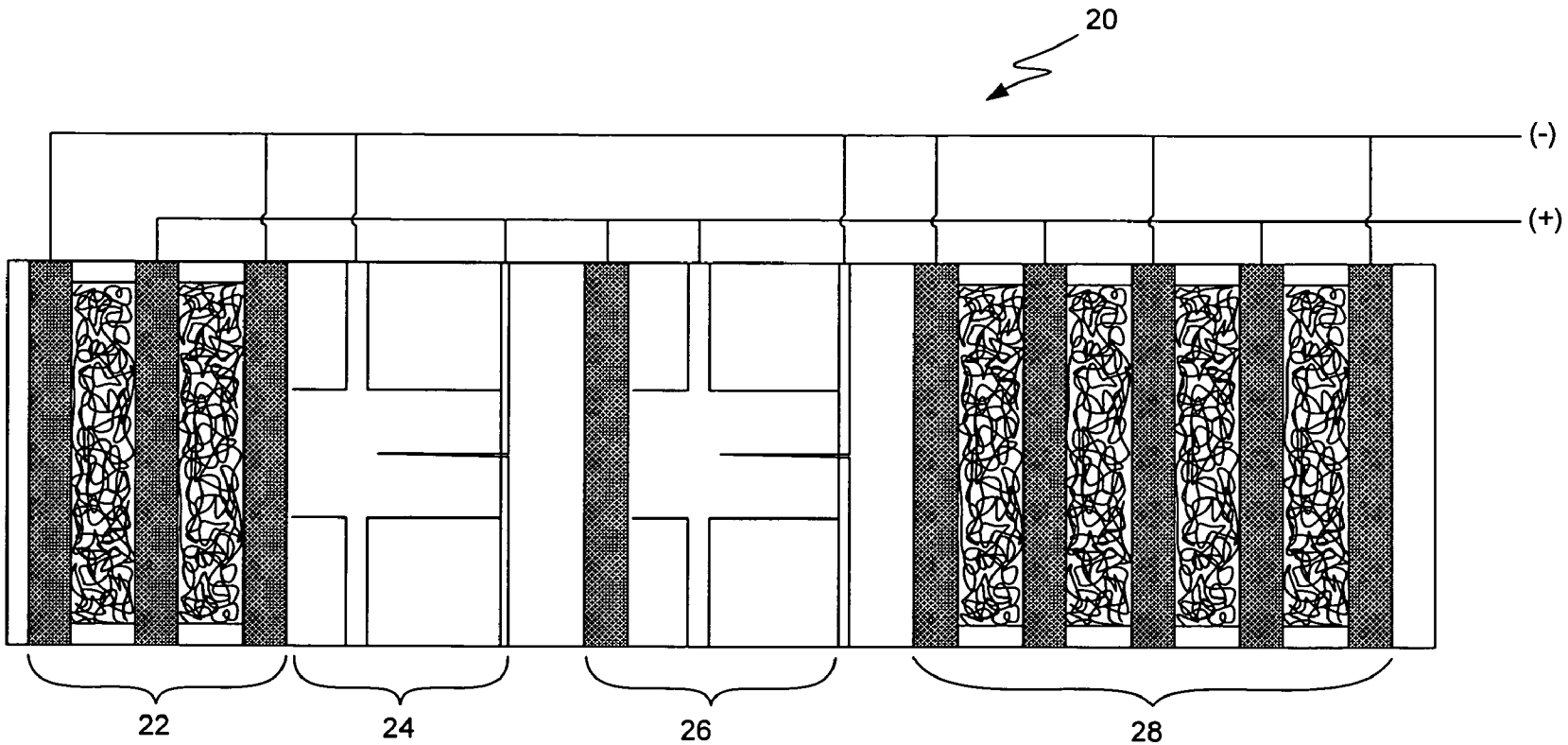
FIG. 8 (prior art)
FIG. 8 is a diagrammatic side view of an existing plasma reactor design that does not include a modular frame.

Referring next to FIG. 7 another embodiment of the modular frame will be described. In this embodiment the frame has a side wall 401 having a shelf 407. The side wall also has a protrusion 411 having a vertical slot 413 therein. The slot 413 receives a flattened rod bus bar 415. An electrical connector 417 has a flat section 421 that sits on a platform 423 that extends from the shelf 407. The flat section has a pair of spring arms 426 that are arranged to engage a component mounted on the shelf. The connector also has a clip 428 that fits in a recess in the protrusion 411 and clips over the edge of the protrusion into the slot 413 where it engages the bus bar 415. In this arrangement the flanges are eliminated from the shelf. Rather the thickness of the edges of the components that lie on the shelves are arranged so that the shelves themselves constrain the movement of the components.

Although only a few embodiments of the invention have been described in detail, it should be appreciated that the invention may be implemented in many other forms without departing from the spirit or scope of the invention. The modular frame has been described primarily in the context of a plasma reactor type air purification device. However, the same modular frame can be used in a variety of different air purification/filtering/treatment systems including ion enhanced electrostatic filters, volatile organic compound (VOCs) treatment systems, catalyst based purification systems, etc.

A few specific embodiments of the frame members have been described. However, it should be appreciated that the construction of the rails and the various features of the frame members (e.g., the latch mechanisms, the seal structures, etc.) may all be widely varied. Therefore, the present embodiments are to be considered as illustrative and not restrictive and the invention is not to be limited to the details given herein, but may be modified within the scope and equivalents of the appended claims.

What is claimed is:

1. An air purification device arranged to treat aerosol particulates carried in a fluid stream passing through the device, the air purification device comprising:

a ionizer arranged to receive the fluid stream, the ionizer including a discharge electrode and a receptor electrode;

at least one electrostatic filter located downstream of the ionizer such that the fluid stream passes through the electrostatic filter after passing through the ionizer, the electrostatic filter including first and second electrodes;

a plurality of frame members arranged in a stack, the frame members being arranged to define a flow channel through which the fluid stream passes and to support components of the air purification device that receive the fluid stream;

a plurality of rods that pass through the frame member stack, wherein a first one of the rods serves as an electrical power source at a first potential and a second one of the rods serves as an electrical power source at a second potential; and a plurality of electrical connectors that each electrically couple an associated one of the electrodes to an associated rod.

2. A plasma reactor that constitutes an air purification device as recited in claim 1 wherein the ionizer is a plasma generator arranged to receive the fluid stream and subject particulates carried in the fluid stream to a cold plasma that has a sufficiently high concentration of reactive species to treat at least some of the particulates passing there through.

3. An air purification device as recited in claim 1 wherein the frame members each have substantially the same dimensions and shape.

4. An air purification device as recited in claim 1 wherein each frame member includes a plurality of rails and at least some of the rails include:

an inner wall;

a shelf that extends inward from the inner wall;

a retention member that extends from the shelf, the height of the retention member being less than the height of the inner wall such that a component that is seated on the shelf of a first frame member may be held in place by the retention member of an adjacent frame member;

at least one latch mechanism suitable for securing the frame member to an adjacent frame member; and at least one seal structure arranged to engage mating structures on an adjacent frame member to provide a fluid seal between the fluid flow channel and a surrounding environment.

5. An air purification device as recited in claim 4 wherein some of the rails further include:

an outer wall; and a cross beam member that couples the inner and outer walls, wherein the rods pass through corresponding openings in the cross beam member.

6. An air purification device as recited in claim 1 wherein at least three rods are provided and wherein a third one of the rods serves as an electrical power source at a third potential.

7. An air purification device as recited in claim 6 wherein the ionizer and the electrostatic filter are operated at different potential differences.

8. An air purification device as recited in claim 6 wherein at least four rods are provided and wherein a fourth one of the rods serves as an electrical power source at a fourth potential.

9. An air purification device arranged to treat aerosol particulates carried in a fluid stream passing through the device, the air purification device comprising:

a ionizer arranged to receive the fluid stream, the ionizer including a discharge electrode and a receptor electrode;

at least one electrostatic filter located downstream of the ionizer such that the fluid stream passes through the electrostatic filter after passing through the ionizer, the electrostatic filter including first and second electrodes;

a plurality of frame members arranged in a stack, the frame members being arranged to define a flow channel through which the fluid stream passes and to support components of the air purification device that receive the fluid stream, wherein each of the frame members is composed of a plurality of connected rails, wherein at least some of the rails include, an inner wall, and a shelf that extends inward from the inner wall, the shelf being arranged to support an associated component of the air purification device.

10. An air purification device as recited in claim 9 wherein at least some of the rails further include a retention member that extends from the shelf, the height of the retention member being less than the height of the inner wall such that a component that is seated on the shelf of a first frame member may be held in place by the retention member of an adjacent frame member.

11. An air purification device as recited in claim 10 wherein the frame members further include:

at least one latch mechanism suitable for securing the frame member to an adjacent frame member; and a plurality of seal structures, each seal structure being arranged to engage mating structures on an associated adjacent frame member to provide a fluid seal between the fluid flow channel and a surrounding environment.

12. An air purification device as recited in claim 9 wherein the frame members further include:

at least one latch mechanism suitable for securing the frame member to an adjacent frame member; and a plurality of seal structures, each seal structure being arranged to engage mating structures on an associated adjacent frame member to provide a fluid seal between the fluid flow channel and a surrounding environment.

13. A plasma reactor that constitutes an air purification device as recited in claim 9 wherein the ionizer is a plasma generator arranged to receive the fluid stream and subject particulates carried in the fluid stream to a cold plasma that has a sufficiently high concentration of reactive species to treat at least some of the particulates passing there through.

14. An air purification device as recited in claim 10 further comprising:

a plurality of rods that pass through the frame member stack, wherein a first one of the rods serves as an electrical power source at a first potential and a second one of the rods serves as an electrical power source at a second potential; and a plurality of electrical connectors that each electrically couple an associated one of the electrodes to an associated rod.

15. An air purification device as recited in claim 14 wherein at least some of the rails of the frame members each further include:

an outer wall; and a cross beam member that couples the inner and outer walls, wherein the rods pass through corresponding openings in the cross beam member.

16. An air purification device as recited in claim 9 wherein the frame members each have substantially the same dimensions and shape.

17. An air purification device as recited in claim 10 wherein each frame member is composed of four rails that define a substantially rectangular footprint.

18. A modular plasma reactor arranged to treat aerosol particulates carried in a fluid stream passing through the device, the plasma reactor comprising:

a plasma generator arranged to receive the fluid stream and subject particulates carried in the fluid stream to a cold plasma that has a sufficiently high concentration of reactive species to treat at least some of the particulates passing there through, the plasma generator including a discharge electrode and a receptor electrode;

at least one electrostatic filter located downstream of the plasma generator such that the fluid stream passes through the electrostatic filter after passing through the plasma generator, the electrostatic filter including first and second electrodes;

a plurality of frame members arranged in a stack, the frame members being arranged to define a flow channel through which the fluid stream passes and to support components of the air purification device that receive the fluid stream, wherein each of the frame members includes, a plurality of rails wherein at least some of the rails include an inner wall, a shelf that extends inward from the inner wall, a retention member that extends from the shelf, the height of the retention member being less than the height of the inner wall such that a component that is seated on the shelf of a first frame member may be held in place by the retention member of an adjacent frame member, wherein each of the electrodes of the electrostatic filter rest on a shelf associated with a first associated frame member and are retained in place at least in part by a retention member associated with a second associated frame member, at least one latch mechanism suitable for securing the frame member to an adjacent frame member, and at least one seal structure arranged to engage mating structures on an adjacent frame member to provide a fluid seal between the fluid flow channel and a surrounding environment;

a plurality of rods that pass through the frame member stack, wherein a first one of the rods serves as an electrical power source at a first potential and a second one of the rods serves as an electrical power source at a second potential; and a plurality of electrical connectors that each electrically couple an associated one of the electrodes to an associated rod.

19. A plasma reactor as recited in claim 18 wherein each electrostatic filter further includes a dielectric layer that is held in place by its associated first and second electrodes and the dielectric layer is sized so that it fits within an interior portion of an associated frame member without resting on any of the frame member shelves.

20. A plasma reactor as recited in claim 18 further comprising a prefilter component that is located upstream of the plasma generator.

21. A plasma reactor as recited in claim 18 further comprising a catalyst component that is located downstream of the at least one electrostatic filter.

22. A plasma reactor as recited in claim 18 further comprising a second plasma generator located downstream of the first plasma generator.

* * * * *